US006154900A

United States Patent [19]

Shaw

[11] Patent Number: 6,154,900

[45] Date of Patent: Dec. 5, 2000

[54] PATIENT TURNING APPARATUS

[76] Inventor: Mark Shaw, 3434 McClintocksburg Rd., Diamond, Ohio 44412

[21] Appl. No.: 09/362,381

[22] Filed: Jul. 28, 1999

[51] Int. Cl.[7] ..... A61G 7/08

[52] U.S. Cl. ..... 5/81.1 R; 5/615; 5/715; 5/632; 5/922

[58] Field of Search ..... 5/81.1 R, 81.1 T, 5/715, 615, 922, 632

[56] References Cited

U.S. PATENT DOCUMENTS

| | | | |
|---|---|---|---|
| Re. 35,299 | 7/1996 | Weedling et al. | 5/81.1 T |
| 3,775,781 | 12/1973 | Bruno et al. | 5/715 |
| 3,895,403 | 7/1975 | Davis | 5/81.1 R |
| 4,825,486 | 5/1989 | Kimura et al. | 5/713 |
| 4,941,220 | 7/1990 | DiMatteo et al. | 5/81 R |
| 4,977,629 | 12/1990 | Jones | 5/715 |
| 5,092,007 | 3/1992 | Hasty | 5/715 |
| 5,103,519 | 4/1992 | Hasty | 5/715 |
| 5,142,720 | 9/1992 | Kelso et al. | 5/715 |
| 5,233,974 | 8/1993 | Senoue et al. | 601/149 |
| 5,325,551 | 7/1994 | Tappel et al. . | |
| 5,375,273 | 12/1994 | Bodine, Jr. et al. | 5/715 |
| 5,394,577 | 3/1995 | James et al. | 5/715 |
| 5,421,044 | 6/1995 | Steensen . | |
| 5,530,974 | 7/1996 | Rains et al. | 5/81.1 T |
| 5,606,754 | 3/1997 | Hand et al. | 5/713 |

FOREIGN PATENT DOCUMENTS

| | | | |
|---|---|---|---|
| 946831 | 1/1964 | United Kingdom | 5/715 |

*Primary Examiner*—Alexander Grosz
*Attorney, Agent, or Firm*—Renner, Kenner, Greive, Bobak, Taylor & Weber

[57] ABSTRACT

A patient turning apparatus (10), for laterally rotating a patient (30), the apparatus including an air supply, a pair of inflatable bladders (14), each having a tab (18) extending from one end, wherein the tab (18) is in communication with the bladder (14), a connector (17) extending from each tab (18) and in communication therewith, tubes connecting the connectors to the air supply, a pair of sleeves (12) adapted to house pair of inflatable bladders (14) and adjustably maintain bladders (14) in an overlapping configuration, a head pad (37) removably attached to the bladders (14), wherein the head pad (37) is adapted to accommodate variously sized patients, a calf raiser (42) adapted to accommodate variously sized patients, removably attached to the sleeves (12), a pair of bolster retainers (52) removably attached to the sleeves (12) each having a flap portion (54) and a retaining loop (58), a pair of bolsters (50), adapted to slidably fit into the retaining loops (58), a removable body pad (32) attached to the bladders (14), and a plurality of straps (62, 64) releasably attached to the body pad (32).

30 Claims, 4 Drawing Sheets

PATIENT TURNING APPARATUS

TECHNICAL FIELD

The present invention relates generally to patient turning apparatus. More particularly, the present invention relates to an apparatus that uses air pressure to laterally rotate a patient. Specifically, the present invention relates to an apparatus that uses overlapping inflatable air bladders to laterally rotate a patient.

BACKGROUND OF THE INVENTION

The number one cause of patient death during a hospital stay is pneumonia. This disease causes the patient's lungs to fill with fluid. It has been found that turning or rotating a patient, elevating one lung above the other, aids in evacuating this fluid from the patient's lungs. In this way, turning mobilizes the fluid in the bronchial tree, where it can work its way into the esophagus and be expectorated.

U.S. Pat. No. 5,092,007 by Hasty, shows a patient turning device that uses spaced inflatable chambers to turn the patient. Hasty turns the patient by partially inflating the spaced chambers and deflating one of the chambers while inflating the other rolling the patient onto its side. Since the chambers are spaced, the apex of the inflated chamber applies force along or outside the patient's extremities, parallel to the spine, near the shoulder area. Thus, the line of force created by the inflated chamber is placed at a large distance from the patient's spine. In larger patients, the line of force would be located beneath the arm and shoulder, and in smaller patients, the line would be outside the shoulder. Disadvantageously, this force is at least partially absorbed by the movement of the shoulder girdle and shoulder joint.

Specifically, application of force outside the shoulder would cause rotation and flexion of the arm within the shoulder joint. This force would similarly cause movement of the shoulder girdle. The shoulder girdle is made up of the clavicle or collar bone and the scapula or shoulder blade. The clavicle and scapula meet at the acromaclavicular joint. The clavicle extends from this joint and meets the manubrium of the sternum at the sternoclavicular joint. Application of force outside the shoulder or on the shoulder causes protraction or forward movement of the distal end of the clavicle. Protraction is seen as an inward-bowing of the shoulder and torso relative to spine. Since Hasty applies a line of force outside or at the shoulder, the initial application of force is absorbed by this motion of the shoulder joint and shoulder girdle, and as a result, less force is initially transmitted to turning the patient.

Furthermore, the Hasty device does not provide adequate constraint for the patient. One major problem during turning is that the patient will slide while performing the turn. The patient can slide onto the wrong side of the inflatable chamber and possibly off the overlay, or the patient will slide towards the uninflated chamber but away from the apex of the inflated chamber lessening the angle of turn. In Hasty's patent, the space between the inflatable side bolster and the patient allows the patient to slide into this area.

As a further disadvantage, the Hasty device does not adequately allow for various patient sizes. Its outrigger chambers are inflatable chambers forming a part of the overlay. Thus, these chambers cannot be moved inwardly or outwardly depending on the patient's size. Furthermore, inflatable bolsters are prone to leakage. A leaking bolster may not be capable of holding sufficient air to support and contain the patient.

In Hasty and other known devices, there is very little head and calf support. In fact, some known devices cannot operate with a head pad. Without support, the patient's head can hang to one side or the other bending the neck causing discomfort and, in some cases, injury. With respect to the lack of calf support, in the Hasty patent, the patient's heels rest on the overlay or bed. During the turn, the weight distribution will shift to the lower side of the body. Consequently, the lower heel will be subjected to a great deal of force compressing the heel and causing the patient discomfort and, in some cases, pressure sores. Moreover, treatment often requires the patient be held in this position for extended periods. During these periods, the patient's lower heel bears a large portion of the patient's body weight. This constant pressure can result in great discomfort, pressure sores, or other injuries.

Thus, there is a need for an adjustable patient turning device capable of accommodating various sized patients and equipped to turn the patient with reduced initial force absorption. There is a further need for a patient turning device that is more comfortable, provides head support, lifts the patient's heels, and prevents the patient from slipping. There is still a further need for a patient turning device that applies force between the spine and shoulder.

SUMMARY OF THE INVENTION

It is, therefore, a primary object of the present invention to provide a novel patient turning apparatus capable of accommodating various sized patients, while applying force between the patient's shoulder and spine reducing initial force absorption.

It is another object of the present invention to provide an apparatus that uses overlapping inflatable bladders to turn a patient.

It is a further object of the present invention to provide an apparatus that elevates the patient's heels during the turn reducing the likelihood of pressure sores.

It is still another object of the present invention to provide an apparatus that restrains the patient to reduce patient sliding.

It is yet another object of the present invention to provide a more comfortable patient turning apparatus.

In general, the present invention contemplates a patient turning apparatus for laterally rotating a patient, including an air supply, a pair of at least partially overlapping bladders in communication with the air supply.

The present invention further contemplates a patient turning apparatus for laterally rotating a patient, including an air supply, a pair of inflatable bladders, each having a tab extending from one end, where the tab is in communication with the bladder, a connector extending from each tab and in communication with therewith, and tubes connecting the connectors to the air supply, a pair of sleeves each enclosing one of the inflatable bladders and wherein the sleeves are releasably attached to each other such that the sleeves adjustably maintain the bladders in an overlapping configuration; a body pad removably attached to the sleeves; a head pad removably attached to the body pad, wherein the head pad is adapted to accommodate variously sized patients; a calf raiser adapted to accommodate variously sized patients, removably attached to the body pad; a pair of bolster retainers having a flat portion and a retaining loop, wherein said bolster retainers are removably attached to said body pad along said flat portion; a pair of bolsters adapted to slidably fit into the retaining loops; and a plurality of straps releasably attached to the body pad, wherein said straps are adapted to secure the patient to the body pad.

The present invention still further contemplates a method of laterally rotating a patient, including the steps of: at least partially overlapping a pair of inflatable bladders connected to an air supply; adjusting the amount of overlap such that upon inflation, an apex of one bladder is located between the spine of the patient and the shoulder of the patient; laying the patient on the pair of bladders; and feeding air from the air supply to at least one of the inflatable bladders until one side of the patient is elevated.

DETAILED DESCRIPTION

Figure 1:
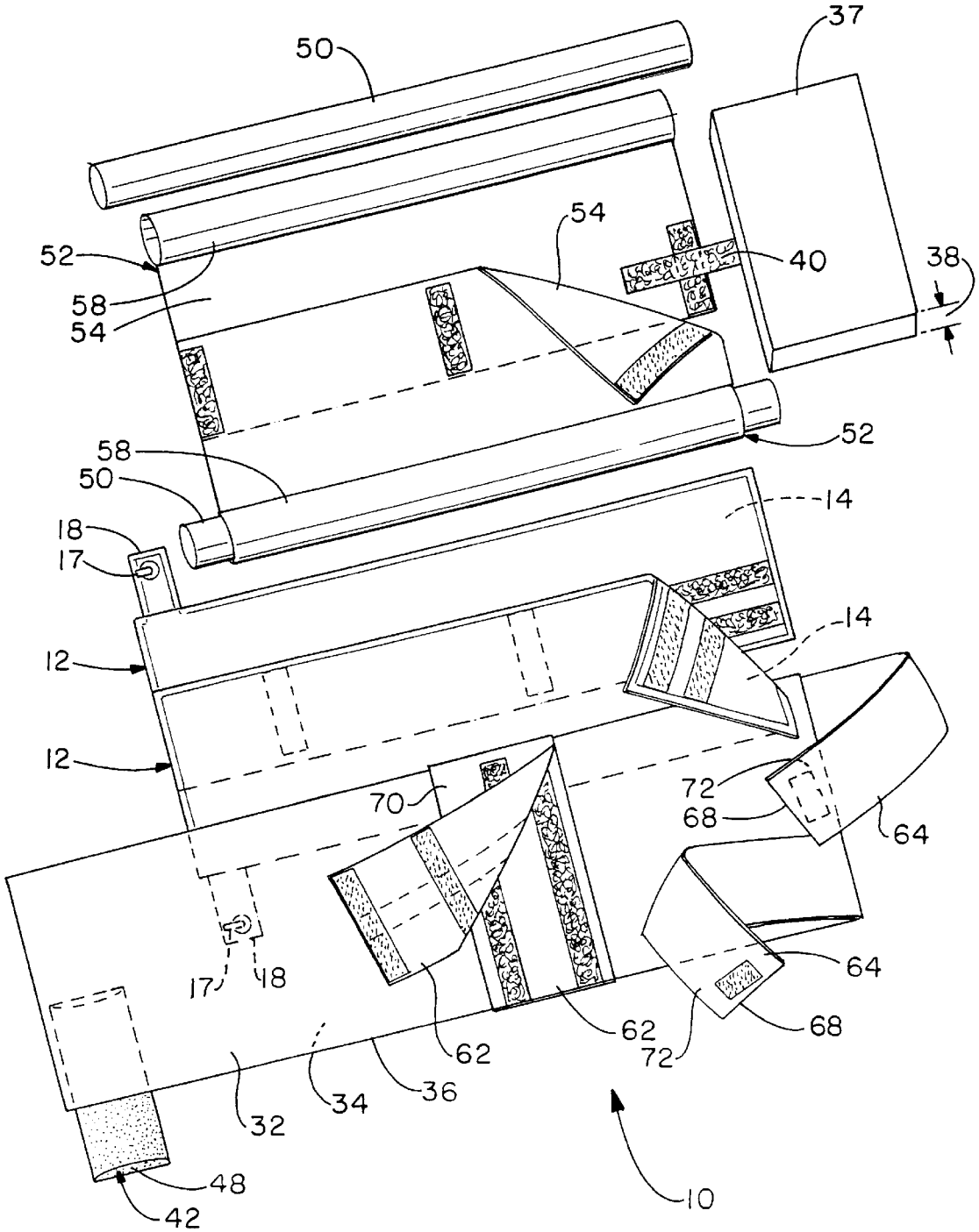
FIG. 1 is an assembly drawing illustrating the various components which may comprise a patient turning apparatus of the present invention.

It has been found that a patient can be efficiently and aggressively turned using overlapping pneumatic bladders as part of a patient turning apparatus. One representative form of a patient turning apparatus embodying the concepts of the present invention is designated generally by numeral 10 on the accompanying drawings. The patient turning apparatus 10 may have at least one sleeve 12 housing two inflatable members or bladders 14. As shown in FIG. 1, each bladder 14 may be placed in its own sleeve 12. Sleeves 12 act essentially as slip covers reducing direct wear to bladders 14 and providing an attachment point for fasteners, such as, VELCRO. In this way, the fasteners do not have to be fixed to the bladders 14. In the event that one of the bladders 14 needs to be replaced or serviced, sleeve 12 may be provided with openings at each end with VELCRO closures (not shown).

Bladders 14 may be generally cylindrical when inflated. When uninflated, bladders 14 may appear as flat rectangular bodies. It should be recognized that bladders 14 may be constructed of almost any shape that applies force capable of elevating one lung of the patient. For example, bladders 14 may be shaped to have a cut-out near the patient's legs to help maintain the patient in general axial alignment with the patient turning apparatus 10. By maintaining this alignment, the patient is held in a more comfortable position.

Figure 2:
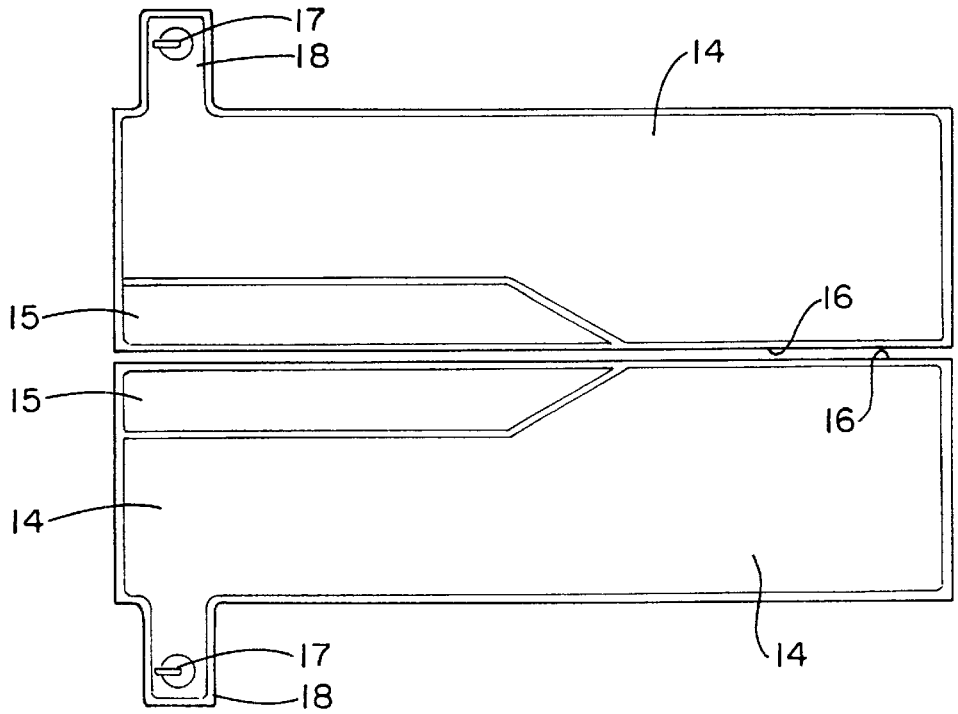
FIG. 2 is a plan view of two inflatable members according to the present invention.
Figure 3:
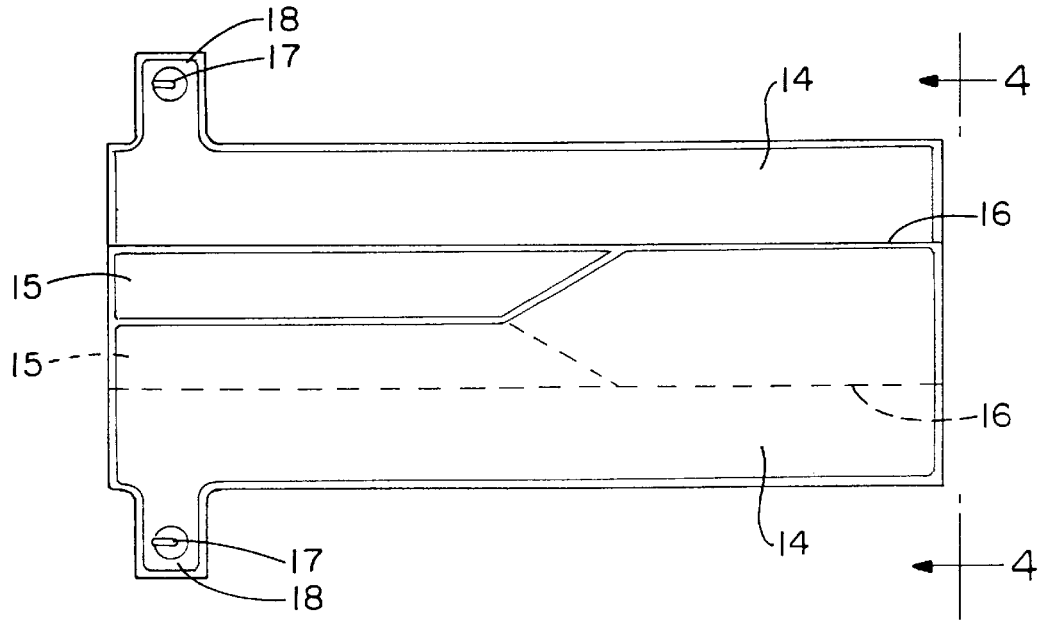
FIG. 3 is a plan view of the two members shown in FIG. 2 as they may be overlapped to form the patient turning apparatus of FIG. 1.
Figure 4:
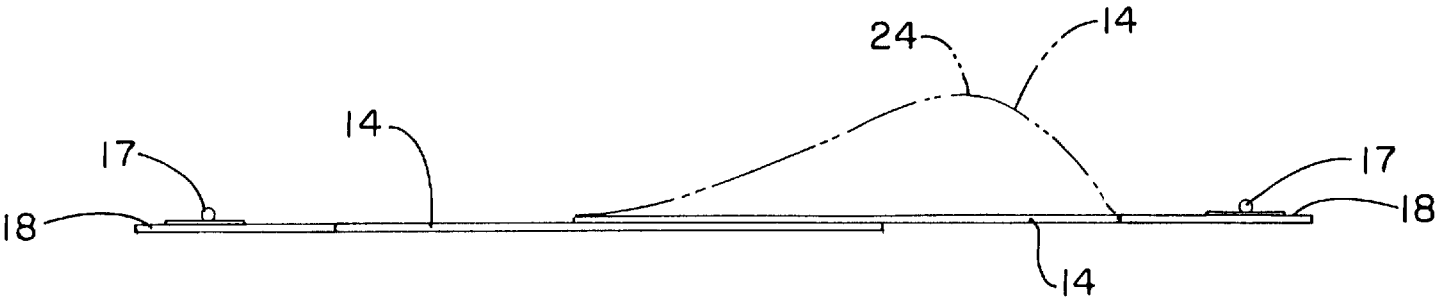
FIG. 4 is an enlarged end view of the present invention as taken at line 4—4 of FIG. 3 illustrating the inflation of one of the members, the inflated portion being shown in ghost lines.

As an alternative, as shown in FIGS. 2 and 3, bladders 14 may be provided with uninflatable portions 15 to provide an uninflated area near the patient's legs. Preventing a portion of the bladders from inflating can be accomplished in any known manner. As an example, the uninflatable portion may be isolated from the inflatable portion by a welded seam.

As shown in FIG. 2, uninflatable portions 15 are located near the inside edge 16 of the bladders 14 and toward one end of the bladders 14. The uninflatable portions 15 have a generally rectangular shape that tapers toward the inside edge 16 near the center of the bladders 14. As best shown in FIG. 3, when overlapped, the uninflated portions 15 of bladders 14 cooperate to form a generally rectangular uninflated area with outwardly tapered ends. During operation, this uninflated area creates a recess to which the elevated leg is drawn.

Each bladder 14 has a tube or connector 17 that is in fluid communication with the air supply and the bladder 14. As shown in FIG. 2, connectors 17 are mounted on tabs 18 that extend through the sides of sleeves 12. Tabs 18 extend from bladders 14 and are in fluid communication with the bladders 14. A small pad constructed of air permeable material is inserted within each tab to provide some rigidity. In this way, the tab 18 is less vulnerable to folding, bending, or other forms of compression that could cut off or impede the supply of air entering tabs 18 from connectors 17 and passing into bladder 14. It should be understood that a wide variety of materials could be used for this purpose including solid materials with internal passages. As shown, tabs 18 are filled with foam.

Tabs 18 space connectors 17 from sleeve 12 lessening the likelihood of having a patient interfere with the supplied air flow. The connectors 17 receive air from a suitable air supply (not shown), such as a pump or pressurized tank. Air flow is channeled by suitable conduits or tubing to connectors 17 from the air supply. Similarly, the flow rate, period of inflation, and inflation of the individual bladders 14 in synchrony or in an alternating fashion can be controlled by any known manner. As one example, connectors 17 are fed separately by tubes running from a manifold. Another tube extends from the air supply 18 to supply the manifold with air. It should be understood that the manifold may receive air from two supply tubes to feed each bladder directly, or the manifold may be omitted. Without a manifold, bladders 14 may fed air directly from air supply.

During inflation, air is directed from the air supply into bladders 14. Bladders 14 are at least partially overlapped defining an overlapped portion therebetween. Because bladders 14 are overlapped, the apex 24, or highest portion, of the inflated bladder 14 is between the patient's spine and shoulder. In one exemplary placement, the apex 24 is about 4 inches from an average adult patient's spine. It should be recognized that ideal placement of the apex is a function of the patient size, and adjustment of the amount of overlap can be made to accommodate different patient sizes. It should be further understood that various sized bladders 14 may be used to change the maximum angle of elevation. To maintain proper placement of the apex, the amount of overlap may vary in reverse proportion to the patient size, or if larger bladders are used it may vary relative to the bladders. For example, a very large angle of elevation may require larger bladders to perform the turn. In this case, the uninflated larger bladders would have an increased width as compared to a smaller bladder. Since the apex is approximately at the center of the bladder 14, the larger bladders would have a greater portion of their widths overlapping each other to bring the bladder apex between the patient's spine and shoulder.

Since the apex 24 is between the spine and shoulder, there is reduced body flexion. In particular, as the line of force created by apex 24 moves inwardly from the patient's shoulder, the movement about the shoulder joint and the shoulder girdle is reduced. Considering only the shoulder joint, a line of force applied beneath the shoulder joint does not create a moment about that joint and, at most, would cause external rotation of the shoulder, which would not absorb the elevational force of bladder 14.

Turning to the shoulder girdle, protraction of the shoulder girdle is allowed by the sternoclavicular joint. As the line of force or apex 24 moves inwardly from the shoulder, the moment arm created between apex 24 and this joint is reduced. As a consequence, the moment about this joint is likewise reduced. Reducing the moments about the shoulder joint and shoulder girdle results in reduced internal rotation and protraction, respectively, and therefore, less force absorption.

As the apex 24 reaches a point substantially beneath the center of the clavicle, the moments about the sternoclavicular joint are substantially offset by soft tissue structures that stabilize the shoulder girdle. At this point, the protraction of the shoulder girdle is essentially eliminated. This point generally corresponds to the interior or long edge of the scapula or approximately four inches from an average patient's spine. As previously stated, the size of the patient will alter the position of this point relative to the patient's spine, and the amount of overlap or size of the bladders may be adjusted accordingly.

By placing the apex 24 between the patient's spine and shoulder, less of the bladder force is absorbed by movement of the shoulder joint and girdle, but instead, more force is transmitted toward turning the patient 30. As a result, the patient is aggressively and accurately turned. The amount of turn can be controlled by controlling the amount of air supplied to each bladder 14. Control of the air supply can be managed manually or automatically by a suitable control device. The controller could adjust the amount of air, or alternate inflation of the bladders. For example, during extended stays, the patient may need to be turned repeatedly from one side to the other. Suitable controls can be used to perform this function automatically.

To improve the bladder's effectiveness and provide a more comfortable turn, several components may be used individually or in combination with bladder 14. It should be understood that these components may be permanently attached to each other or bladders 14. Preferably, all of the components are removably fastened to ease cleaning and storage of the device. Suitable removable fasteners devices include hook-and-eye closures, such as VELCRO, snaps, or buttons. VELCRO is most preferable because of its ease of use, and because a continuous surface can be maintained. This surface prevents fluids from gathering around fasteners or seeping between them. Moreover, VELCRO attachment allows easy adjustment of each component to accommodate different patient sizes.

During the turning procedure, body pad 32 supports and cushions the patient's body. Body pad 32 is a generally rectangular pad of substantially constant thickness. It should be understood that body pad 32 may be contoured to fit the patient or provide additional support in a specific area. For example, body pad 32 may have an integral calf raiser. Body pad 32, also, may cover the bladder 14, or extend beyond the bladders 14 to act as a head pad or calf raiser. Alternatively, body pad 32 may cover the head pad, calf raiser 42, or both. To keep body pad 32 from moving, body pad 32 is preferably secured to bladders 14 by VELCRO.

A VELCRO strip may be centrally attached to underside 34 of body pad 32. This strip would interlock with a corresponding strip on sleeve 12. Similar strips may be placed at the edges 36 of body pad 32 to secure other components as described more fully below.

The head pad 37, shown in FIG. 1, is a generally rectangular shaped pad. As can be appreciated virtually any shaped pad large enough to support the patient's head is acceptable. Head pad 37 has a head pad thickness 38. Preferably, head pad thickness 38 decreases slightly in a middle portion of head pad 37 cradling the patient's head, and keeping the patient's airway open.

As shown, head pad 37 has a VELCRO tongue 40 extending from the bottom of the head pad. This tongue 40 is located near the center of the front edge 41 of head pad 37. A corresponding strip of VELCRO is attached to body pad 32. The length of the VELCRO tongue 40 allows the head pad 37 to be moved closer to or farther from bladders 14. Only a portion of tongue 40 must be interlockigly engaged with the receiving VELCRO on the bladders 14 to secure the head pad 37. In this way, head pad 37 may be moved to accommodate different sized patients. For example, to move head pad 37 away from bladders 14, only the tip of tongue 40 interlockingly engages the receiving strip on body pad 32. To further accommodate different sized patients, different sized pillows can be used to ensure the patient's head is supported substantially throughout the turning process. Use of the VELCRO tongue 40 facilitates substitution of a different sized pillow to fit the patient. Using different sized pillows allows the head pad to be placed immediately adjacent to sleeve 12 while providing sufficient padding to extend around the patient's head.

At the opposite end of sleeve 12, a calf raiser pad 42 is placed beneath the patient's calves, and elevates the patient's legs to aid in the turning process. So elevated, the patient's heels 40 are suspended above the supporting surface 46 and free to rotate. The pad's thickness is used to contact and support the patient under the calves, while providing space for the heels to hang freely. As shown, the calf raiser 42 has a semicircular profile 49 that contacts the patient's calves, and is sized, such that, the patient's heels extend beyond the pad 42 to hang freely. To allow for different patient heights, calf raiser 42 is movable. As can be appreciated, a suitably sized pad placed beneath the patient's legs will raise the patient's heels. Since the weight of the patient's legs may be used to hold the calf raiser 42 in place, calf raiser 42 does not have to be attached to body pad 32. Or, calf raiser 42 may be secured to body pad 32 by VELCRO, in a similar manner to the head pad 37. As with head pad 37, the calf raiser 42 is shown as a generally rectangular-shaped pad with a raised thickness, and, similarly, any shape capable of supporting the patient's calves 38 throughout the turn can be used.

Figure 5:
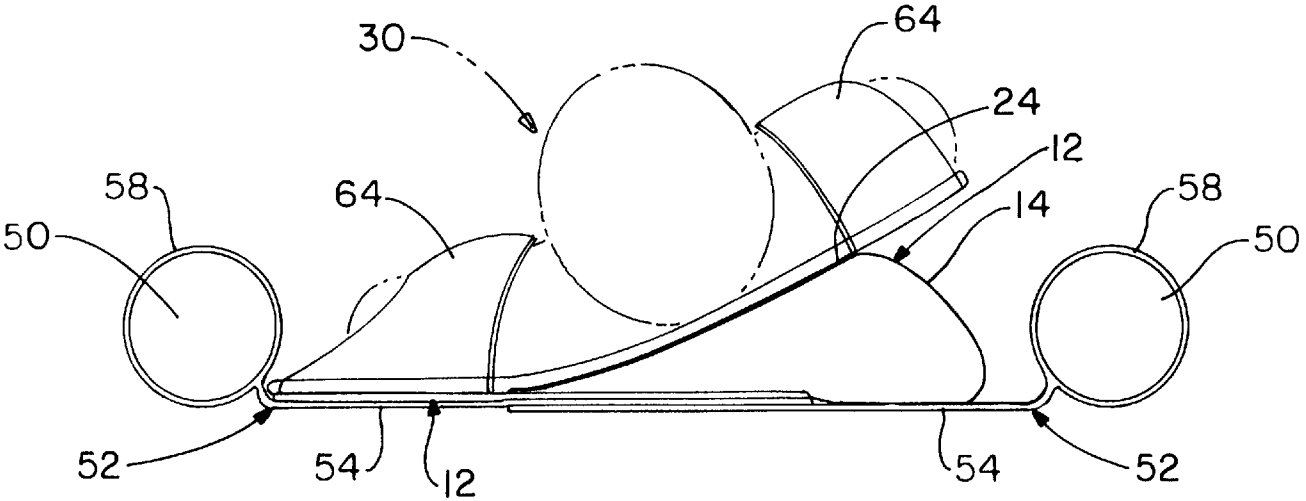
FIG. 5 is a head-end view of the total patient turning apparatus of FIG. 1 illustrating the turning of a patient shown in ghost lines for the purpose of the description.
Figure 6:
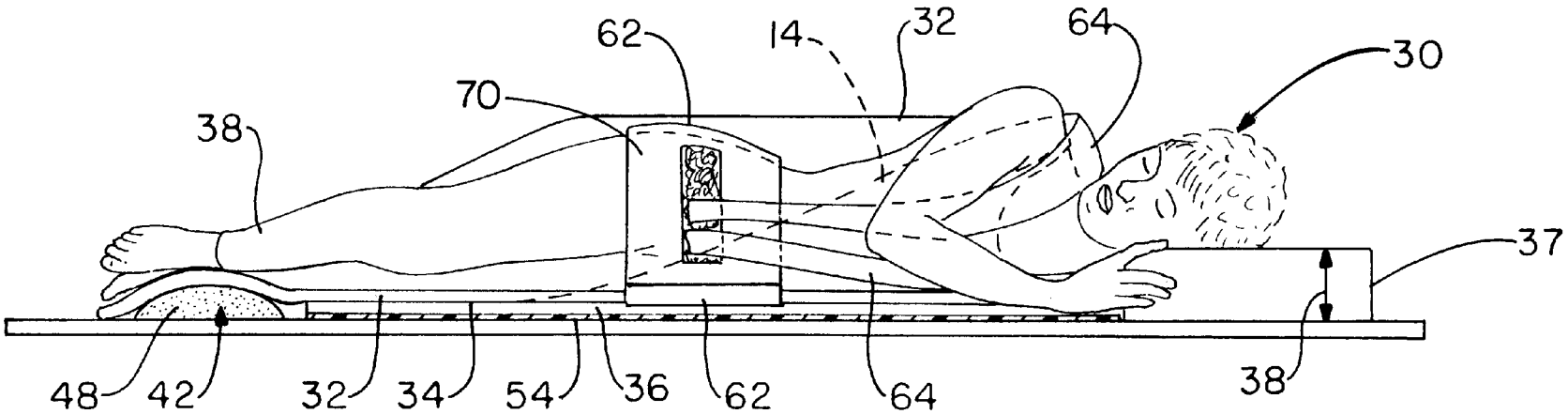
FIG. 6 is a longitudinal left side view of the patient turning apparatus with some members removed for the purpose of the description and illustrating a repositioning of a human form upon inflation of the right-hand member of the apparatus.

At times, patients will slip or slide as they are turned. Anticipating this sliding makes it difficult to aggressively turn the patient. Moreover, as the patient slides away from the bladder's apex 24, the patient's angle of elevation decreases reducing the turn's effectiveness. To prevent sliding, side bolsters 50 may be placed alongside the patient 30. As shown, side bolsters 50 are constructed of foam, but bolsters 50 may be filled with other padding materials including gas. Adjusting the bolsters 50 to hug the patient 30 helps prevent sliding during the turn. As best shown in FIG. 5, bolsters 50 may be positioned to hug the patient by inserting them within adjustable bolster retainers 52. Bolster retainer 52 has a flap portion 54 with a strip of VELCRO 56 attached near the edge of the flap 54. At least one bolster retaining loop 58 extends from the flap portion 54. The flap portions 54 can be attached to corresponding VELCRO strips on the body pad 32 or on each other. The VELCRO strips are sized, or a plurality of strips can be used, to allow inward and outward movement of the bolster retainers 52.

In operation, the flap portions 54 are laid out and adjusted to accommodate the patient's torso before the patient lays on top of the apparatus 10. Finally, the bolsters 50 are inserted within the bolster retaining loop 58. It should be understood that bolsters 50 can be attached directly to body pad 32 by flap portion 54. Use of the separately insertable bolsters 50 is preferred, however, because these retainers are easily rolled up before the patient lays on the apparatus. Once the patient is on the apparatus 10, the patient 30 may be lifted to one side to allow final adjustment of the retaining loops 58. Once adjusted, retainers 52 and any other components are unrolled flat on the supporting surface. Then, the patient is laid down, and bolsters 50 may be inserted close to the patient 30.

To further hold the patient 30, straps may be positioned over or around the patient's body. In addition to bolsters 50, these straps may hold patient 30 in place during the turn. Moreover straps may be used to hold the patient in a better position for turning, and give the patient a sense of security during the turn. These straps may be placed at various locations, depending on the treatment conditions to secure the patient 30. For example, at times patients are left with open wounds after surgery, but still must be turned. In these situations, the straps are moved to avoid contact with wound. As shown in FIG. 5, the straps preferably will extend across the patient's torso and over the patient's shoulders. Lateral straps 62 restrict sideward patient motion, and shoulder straps 64 restrict forward patient movement. Restricting forward movement reduces the likelihood of placing pressure on the patient's head and spine, or moving the head and spine from their proper turning position.

Although lateral straps 62 and shoulder straps 64 may be attached to the supporting surface, the sleeve 12, or any other object close to bladders 14, it is preferred to attach the straps to body pad 32. In this way, the straps remain in essentially the same configuration throughout the turn. If the straps, however, are attached to the sleeve 12, for example, the tension on the straps will increase as the patient is elevated away from sleeve 12. This increased tension may constrict the patient, causing discomfort. To attach the straps to body pad 32, the lateral strap ends(not shown) and shoulder strap ends 68 are provided with VELCRO strips that engage corresponding strips on underside 34 of body pad 32. Lateral straps 62 may further be provided with VELCRO on their outside surface 70 to attach to corresponding VELCRO strips on the underside 72 of shoulder straps 64.

In general, the patient turning apparatus components are covered with any type of material. It is preferable to use polymeric materials, including GORTEX, that are liquid impervious to prevent liquids from soaking into the padding. More preferable materials include vinyls and nylons. It is most preferable to use a nylon with low moisture vapor transfer because of its comfort level.

To turn a patient with the patient turning apparatus 10, sleeve 12 is placed on top of the supporting surface, the body pad 32 is attached to sleeve 12 by VELCRO, if necessary. The head pad 37, calf raiser 42, and bolsters 50 may be attached to body pad 32. Similarly, the lateral straps 62 and shoulder straps 64 are attached by VELCRO to the underside of body pad 32. The patient is laid on top of the apparatus 10, and side bolsters 50 are inserted into their respective bolster retaining loops 58. Finally, the patient 30 is strapped in with the straps.

To turn the patient 30, air from the air supply is directed into one of the bladders 14. As the bladder 14 inflates, the apex 24 transmits force to an area between the patient's spine and shoulder elevating one side of the patient. To achieve proper placement of the force line, it may be necessary to change the bladder size and adjust the amount of overlap. For example, for a very large person, larger bladders 14 may be required to lift the patient. Larger bladders 14 would have increased widths and, accordingly, the distance between the apex 24 and the edge of bladders 14 would be increased. To accommodate this increase and place the apex 24 near the optimal position, the amount of overlap between the two bladders 14 would increase. Smaller bladders 14 and reduced overlap may be necessary for smaller patients, such as, children. Once appropriately placed, one bladder 14 is inflated to elevate one side of the patient 30. During this elevation the bolsters 50 and straps cooperate to snugly hold the patient in place.

Since straps are attached to body pad 32, the strap configuration remains generally uniform. When straps are attached to body pad 32, the patient and the straps are elevated at the same time. It should be understood that the configuration of straps may change to an extent due to the shift in the patient's weight distribution during the turn.

Thus, it should be clear from above description that the objects of the invention have been achieved by the patient turning apparatus and methods described therein. While a only preferred embodiment of the invention has been described in detail, it should be understood that modifications could be made thereto, and are intended to be included within the present invention. Accordingly, to appreciate the scope of the present invention, reference should be made to the following claims.

What is claimed is:

1. A patient turning apparatus for laterally rotating a patient, the apparatus comprising an air supply; a pair of at least partially overlapping bladders in communication with said air supply, said bladders being releasably attached to allow adjustment of said bladders to accommodate different patients.

2. The patient turning apparatus of claim 1, further comprising a body pad covering said bladders, wherein said body pad has a first end, a second end, and sides.

3. The patient turning apparatus of claim 2, farther comprising at least one bolster located adjacent to one side of said body pad.

4. The apparatus of claim 3, further comprising a pair of bolster sleeves having a loop portion for receiving said bolsters;

a flap portion extending from said loop portion releasably attached to said body pad.

5. The patient turning apparatus of claim 2, further comprising:

a head pad removably attached to said body pad;

at least one strap removably attached to body pad;

a calf raiser located under the legs of the patient; and a pair of bolsters adjacent said sides of said body pad.

6. The apparatus of claim 5, wherein the head pad includes a generally rectangular pad, having a middle portion, an upper portion, and a lower portion; the upper and lower edge portions having a greater thickness than the middle portion.

7. The apparatus of claim 5, wherein said bolsters are generally cylindrical pads having an attachment flap extending therefrom, wherein said attachment flap releasably attaches to said body pad.

8. The apparatus of claim 5, wherein said body pad is a generally rectangular pad having a thickness, and said body pad covering said bladders and said calf raiser.

9. The apparatus of claim 5, wherein said head pad, said calf raiser, said bolsters, and said body pad are removably attached with hook-and-eye closures.

10. The patient turning apparatus of claim 2, wherein said body pad is longer than said bladders.

11. The patient turning apparatus of claim 1, further comprising a calf raiser located under the calves of the patient.

12. The patient turning apparatus of claim 11, wherein the calf raiser includes a generally rectangular pad having a half circular profile.

13. The patient turning apparatus of claim 1, further comprising a head pad located under the head of the patient.

14. The patient turning apparatus of claim 1 further comprising a pair of sleeves each enveloping one of said bladders.

15. The patient turning apparatus of claim 14, wherein when one of said bladders is inflated said overlapping configuration places an apex of said bladder between the shoulder joint of the patient and the spine of the patient.

16. The patient turning apparatus of claim 15 wherein said overlapping configuration places said apex between the shoulder joint of the patient and the scapula of the patient.

17. The patient turning apparatus of claim 15 wherein said bladders are adjustable such that said apex is placed between the scapula of the patient and the spine of the patient.

18. The patient turning apparatus of claim 17 wherein said overlapping bladders are adjustable such that said apex is placed beneath the scapula of the patient.

19. The patient turning apparatus of claim 18 wherein said overlapping bladders are adjustable such that said apex is placed beneath the long edge of the scapula of the patient.

20. The apparatus of claim 1, further comprising a pair of tabs extending from and in communication with said bladders; a pair of connectors extend from and in communication with said tabs.

21. The apparatus of claim 20, further comprising an air permeable member housed within said tabs.

22. The apparatus of claim 21, wherein said air permeable member is constructed of foam.

23. The apparatus of claim 1, wherein said bladders having an uninflatable portion located near the legs of the patient.

24. A method of laterally rotating a patient, comprising:

overlapping a pair of inflatable bladders connected to an air supply said bladders being releasably attached to each other;

adjusting the amount of overlap such that upon inflation, an apex of one bladder is located between the spine of the patient and one shoulder of the patient;

laying the patient on said pair of bladders; and feeding air from the air supply to at least one of said inflatable bladders until one lung of the patient is elevated.

25. The method of claim 24 wherein the amount of overlap is adjusted such that said apex is located between the scapula of the patient and the spine of the patient.

26. The method of claim 25 wherein the amount of overlap is adjusted placing said apex beneath the edge of the scapula of the patient.

27. The method of claim 24 further comprising the steps of:

before laying the patient on said pair of bladders, placing a body pad over said pair of bladders;

attaching a first strap at a side of said body pad;

attaching a pair of shoulder straps to one end of said body pad;

positioning a head pad to support the head of a patient;

positioning a calf raiser beneath the legs of the patient;

attaching a bolster retainer having a loop portion and a flat portion, such that said flat portion is secured to an underside of said body pad, holding the loop portion adjacent to said body pad;

after laying the patient on top of said body pad, inserting a bolster within said loop portion;

laterally extending said first strap over said patient and securing said first strap to an opposite side of said body pad; and extending said pair of shoulder straps inwardly over the shoulders of the patient and securing said pair of straps to said first strap.

28. A patient turning apparatus, for laterally rotating a patient, the apparatus comprising:

an air supply;

a pair of inflatable bladders, each having a tab extending from one end, wherein said tab is in fluid communication with said bladder;

a connector extending from each tab and in communication therewith;

tubes connecting the connectors to said air supply;

a pair of sleeves each enclosing one of said pair of inflatable bladders and wherein said sleeves are releasably attached to each other, such that said sleeves adjustably maintain said bladders in an overlapping configuration;

a body pad removably attached to said sleeves;

a head pad removably attached to said body pad, wherein said head pad is adapted to accommodate variously sized patients;

a calf raiser adapted to accommodate variously sized patients, wherein said calf raiser is removably attached to said body pad;

a pair of bolster retainers having a flap portion and a retaining loop, wherein said bolster retainers are removably attached to said body pad along said flap portion;

a pair of bolsters, adapted to slidably fit into said retaining loops; and a plurality of straps releasably attached to said body pad, wherein said straps are adapted to secure the patient to said body pad.

29. A method of laterally rotating a patient having a spine located between first and second shoulders comprising:

providing a patient turning apparatus having first and second inflatable bladders connected to an air supply, the first bladder having a first apex and the second bladder having a second apex, when inflated;

configuring the bladders beneath the patient such that when inflated the first apex of the first bladder contacts the patent between the spine and the first shoulder and the second apex of the second bladder contacts the patient between the spine and the second shoulder throughout the rotation of the patient; and selectively inflating at least one of the bladders to elevate one side of the patient.

30. The method of claim 29 wherein the step of configuring the bladders beneath the patient includes placing the apexes of the first and second bladders beneath respective scapula of the patient.

* * * * *